US009163916B2

(12) United States Patent
Aw et al.

(10) Patent No.: US 9,163,916 B2
(45) Date of Patent: Oct. 20, 2015

(54) ELECTRO-MECHANICAL FUZE FOR A PROJECTILE

(75) Inventors: Cheng Hok Aw, Singapore (SG); Juan Kiat Jeremy Quek, Singapore (SG); Yong Lim Thomas Ang, Singapore (SG); Siwei Huang, Singapore (SG); Soo Chew Sie, Singapore (SG)

(73) Assignee: Advanced Material Engineering Pte Ltd, Singapore (SG)

( * ) Notice: Subject to any disclaimer, the term of this patent is extended or adjusted under 35 U.S.C. 154(b) by 0 days.

(21) Appl. No.: 13/503,853

(22) PCT Filed: Mar. 22, 2012

(86) PCT No.: PCT/SG2012/000097

§ 371 (c)(1),
(2), (4) Date: Apr. 25, 2012

(87) PCT Pub. No.: WO2012/138298

PCT Pub. Date: Oct. 11, 2012

(65) Prior Publication Data

US 2012/0291650 A1 Nov. 22, 2012

(30) Foreign Application Priority Data

Apr. 2, 2011 (SG) ..... 201102356-1

(51) Int. Cl.

| | |
|---|---|
| ***F42C 1/02*** | (2006.01) |
| ***F42C 9/16*** | (2006.01) |
| ***F42C 11/00*** | (2006.01) |
| ***F42C 11/02*** | (2006.01) |
| ***F42C 15/40*** | (2006.01) |
| ***F42C 15/188*** | (2006.01) |

(52) U.S. Cl.

CPC ... *F42C 1/02* (2013.01); *F42C 9/16* (2013.01); *F42C 11/00* (2013.01); *F42C 11/008* (2013.01); *F42C 11/02* (2013.01); *F42C 15/188* (2013.01); *F42C 15/40* (2013.01)

(58) Field of Classification Search

CPC ..... F42C 1/02; F42C 1/09; F42C 9/16; F42C 11/00; F42C 11/02; F42C 15/40; F42C 15/188; F42C 15/196; F42C 11/008

USPC ..... 102/200, 206, 207, 208, 209, 210, 215, 102/216, 222, 247, 251, 254, 262, 265, 266

See application file for complete search history.

(56) References Cited

U.S. PATENT DOCUMENTS

| | | | | |
|---|---|---|---|---|
| 3,633,510 A * | 1/1972 | Bernardin | ..... | 102/254 |
| 3,967,556 A * | 7/1976 | Post et al. | ..... | 102/209 |
| 4,176,608 A * | 12/1979 | Ambrosini et al. | ..... | 102/216 |

(Continued)

FOREIGN PATENT DOCUMENTS

| | | |
|---|---|---|
| GB | 2221521 A * | 2/1990 |
| WO | WO 2012138298 A1 * | 10/2012 |

OTHER PUBLICATIONS

Written Opinion of the International Searching Authority for PCT/SG2012/000097; May 18, 2012.*

*Primary Examiner* — James S Bergin

(74) *Attorney, Agent, or Firm* — Pyprus Pte Ltd

(57) ABSTRACT

The present invention describes an electronic fuze (200) operable to complement a mechanical point impact fuze (101). The electronic fuze (200) includes a voltage generator circuit (210), micro-controller (220), a piezo-electric sensor (262), a firing circuit (280) and a safety lockout circuit (290). When a projectile (50) strikes a target at an optimum angle, the mechanical point impact fuze (101) is activated; when the strike angle is oblique, the mechanical point impact fuze may be ineffective but the piezo-electric sensor (262) is operable to trigger the firing circuit (280). The safety lockout circuit (290) ensures the firing circuit (280) is operative only after a predetermined delay time when an n-channel FET (292) is turned OFF. The micro-controller (220) also generates a TIME-OUT signal, which provides for self-destruction of a projectile that has failed to explode.

13 Claims, 8 Drawing Sheets

(56) References Cited

U.S. PATENT DOCUMENTS 4,241,662 A * 12/1980 Rudenauer et al. ..... 102/210
4,580,498 A * 4/1986 Abt et al. ..... 102/215
4,603,635 A * 8/1986 Boudreau ..... 102/206
5,705,766 A * 1/1998 Farace et al. ..... 102/215
6,237,495 B1 5/2001 Hok et al.
7,729,205 B2 6/2010 Siebott et al.

* cited by examiner

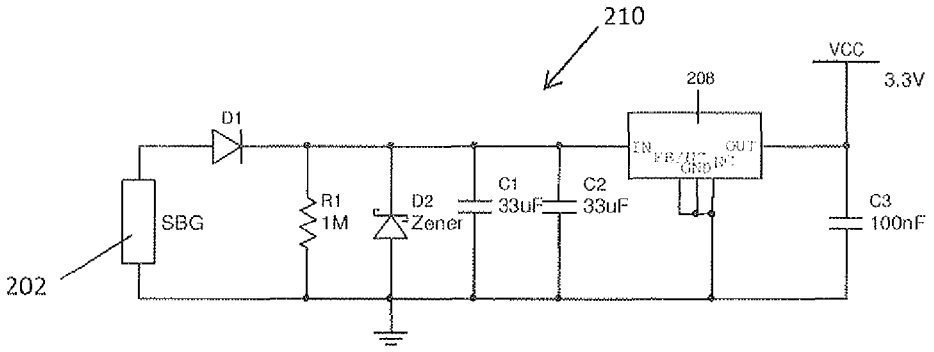
FIG. 3A
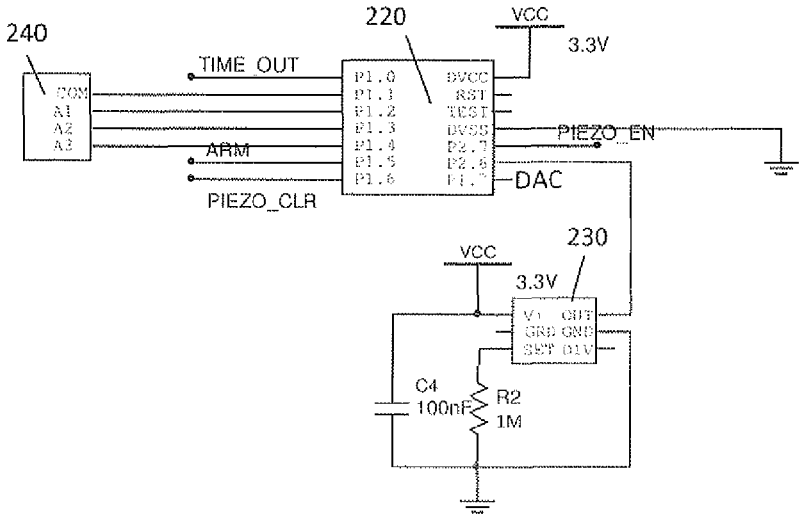
FIG. 3B
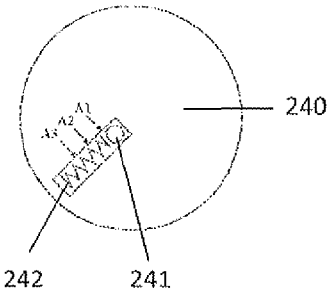
FIG. 3B1

FIG. 3C1

ELECTRO-MECHANICAL FUZE FOR A PROJECTILE

FIELD OF INVENTION

The present invention relates to an electro-mechanical fuze for a projectile. In particular, this invention relates to an electronic firing circuit with impact sensing and self-destruct features to complement a mechanical point impact mechanism.

BACKGROUND

A round 10, that is typically launched from a barrel of a weapon, consists of a cartridge case 20, a body 30 and a nose cone 40 being arranged in this order along a longitudinal axis 12, as shown in FIG. 1. A fuze (not shown), housed inside the nose cone 40, is a safety device that ensures that the projectile is safe until it has been propelled a predetermined distance away from the muzzle of the barrel; in other words, the projectile is armed only after it has been propelled over a minimum safe muzzle distance. A conventional mechanical fuze is now exemplified: once the projectile is propelled through the barrel, a spin-activated lock releases an unbalanced rotor. Rate of rotation of the rotor is regulated by a pinion assembly and a verge assembly so that after a predetermined delay time and the projectile has reached a tactical distance, the rotor is rotated into its armed position and a stab detonator on the rotor becomes aligned with a point detonating (PD) pin. Once armed, the rotor remains held in this armed position by an arming lock pin. When the nose cone strikes a target at a designed or optimum angle, ie. during such point impact mode, impact forces thrust a safe-and-arm assembly unit, on which the rotor is attached, forward and the PD pin then sets off the stab detonator. The stab detonator may in turn set off a booster 32 and/or an explosive charge 34 disposed inside the body of the projectile.

In some projectiles, there is a mechanical self-destruct mechanism disposed between the safe-and-arm assembly unit and nose cone. The mechanical self-destruct mechanism is a second safety device for setting off the stab detonator after the projectile misses its target, lands on soft ground or lands on a ground at a glazing angle and comes to rest very slowly. A mechanical self-destruct feature may use a spin-decay mechanism to release a spring loaded self-destruct (SD) firing pin onto the stab detonator after the projectile failed to explode by point impact. Applicant's own spin-decay self-destruct fuze is described in U.S. Pat. No. 6,237,495.

The above point impact detonation (PD) and self-destruct (SD) mechanisms require precise movements of mechanical parts. Sometimes, projectiles impact targets at oblique angles; this is often encountered in urban terrains; oblique target surfaces are also encountered with armoured vehicles which are specially designed with body plates arranged at some angles. Impacts at oblique angles can often damage the PD and/or SD mechanisms. As suggested in "Weapon Effect_MOUT_B0386" by the US Military Operations On Urbanized Terrain (MOUT), about 25% of projectiles used in urban terrains are rendered inoperative. Unexploded projectiles pose a hazard and thus it becomes a requirement that newly developed explosive ordnance devices have self-destruct functionality.

In an approach, U.S. Pat. No. 7,729,205, assigned to Action Manufacturing Company, describes a low current micro-controller circuit for use on a projectile. It also describes a system for accurate timing of a fuze circuit.

It can thus be seen that there exists a need for a new fuze system of high reliability to ensure that most projectiles after being deployed are exploded, either by impact and/or by self-destruct triggering.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide an electro-mechanical fuze with high reliability of about 99% or more with 95% confidence level or higher. This is achieved with a mechanical fuze and an electronic fuze circuit.

In one embodiment, the present invention provides a fuze for a projectile comprising: a set-back generator to supply electric power; an impact sensor trigger circuit and a safety lockout circuit coupled to an electronic firing circuit; and an electric detonator disposed in-line with a firing pin; wherein, upon impact of said projectile on a target, said impact sensor trigger circuit sends a firing signal, depending on said safety lockout circuit, to said electronic firing circuit to set off said electric detonator, which in turn is operable to actuate said firing pin to set off a stab detonator.

In another embodiment, the present invention provides a method for controlling a fuze of a projectile, the method comprising: coupling a signal of a piezo-electric sensor and a safety lockout circuit to an electronic firing circuit; wherein said electronic firing circuit is operable to set off an electric detonator in an impact sensing mode, which in turn is operable to actuate a firing pin to set off a stab detonator. In one embodiment, coupling a signal of the piezo-electric sensor to the electronic firing circuit comprises sending the piezo-electric output signal to control a gate of a SCR.

In one embodiment of the firing pin, it is non-compliant in a forward direction in relation to direction of travel of said projectile to allow said firing pin to set off said stab detonator but is compliant in a rearward direction, so that when said electric detonator is set off, a thrust is generated to actuate said firing pin onto said stab detonator.

In one embodiment of the safety lockout circuit, it comprises an n-channel field-effect transistor (FET) whose drain is connected to a gate of a silicon-controlled rectifier (SCR) and source is connected to ground, such that after said projectile has been propelled through a tactical distance, a voltage pulse Vin generated by said set-back generator decreases to a predetermined low level so that a voltage applied to a gate voltage line of said n-channel FET can no longer hold said n-channel FET in conduction, said n-channel FET becomes turned OFF, and as a result, said safety lockout circuit becomes deactivated and said firing signal is then sent to said gate of said SCR to turn said SCR ON, which in response is operable to set off said electric detonator.

In one embodiment of the impact sensor trigger circuit, it comprises a piezo-electric sensor, a gated D-latch and a voltage comparator.

In another embodiment of the fuze, it comprises a micro-controller and a spin loss sensor. The spin loss sensor output is connected to an input of the micro-controller outputs, whilst the micro-controller outputs a PIEZO_EN, PIEZO_CLR, ARM, TIME_OUT and DAC signals. In one embodiment, the DAC signal drives the reference voltage of the voltage comparator; the DAC signal may be varied from a high to a relative low level as the projectile approaches its target. In yet another embodiment, the ARM signal is connected to the gate voltage line of the n-channel FET; the ARM signal may be a high-to-low signal.

BRIEF DESCRIPTION OF THE DRAWINGS

This invention will be described by way of non-limiting embodiments of the present invention, with reference to the accompanying drawings, in which:

FIG. 3A illustrates a power generation and voltage regulation circuit for use in the fuze system shown in FIG. 3 according to another embodiment of the present invention;

FIG. 3B illustrates a controller for use with the fuze system shown in FIG. 3 according to another embodiment of the present invention, whilst FIG. 3B1 illustrates a spin-loss sensor with 3 electrical contacts;

FIG. 3C1 illustrates an impact sensing trigger circuit according to another embodiment of the present invention.

DETAILED DESCRIPTION

Figure 1:
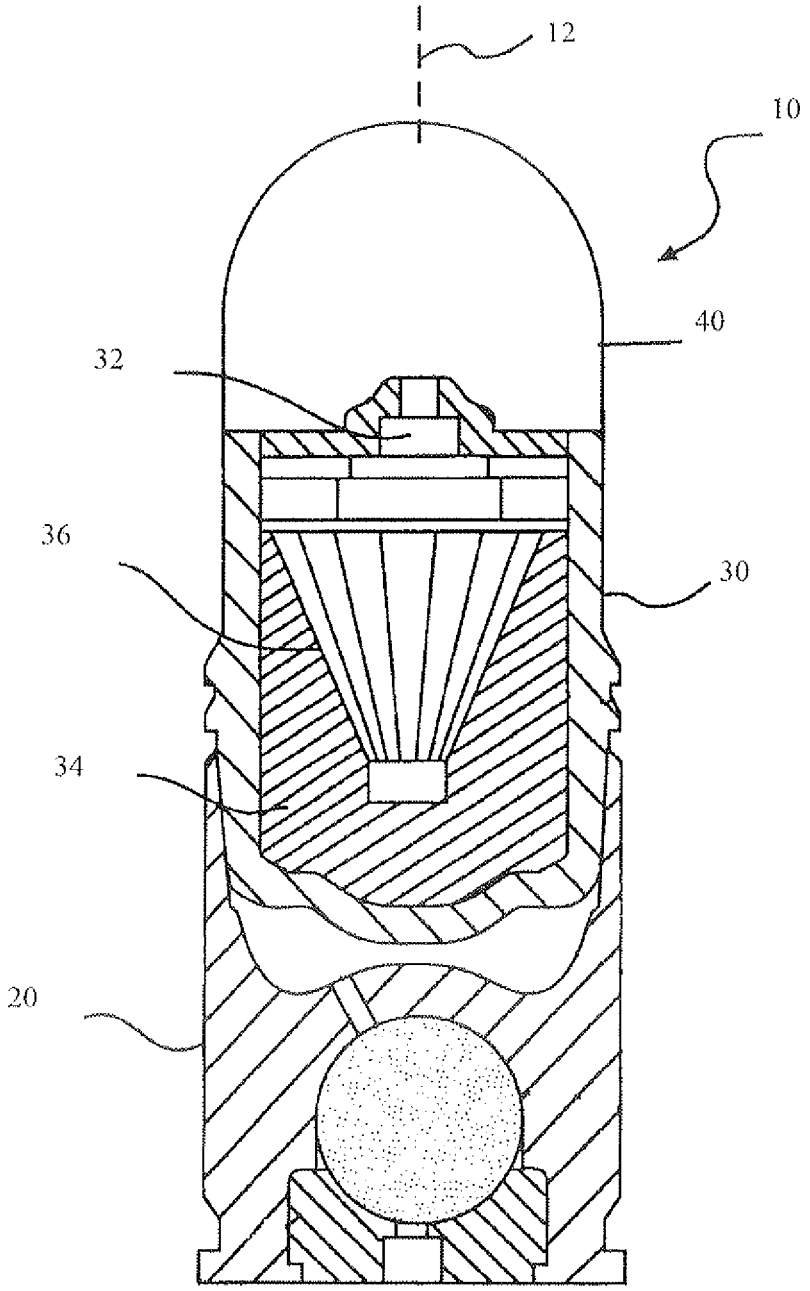
FIG. 1 (PRIOR ART)
FIG. 1 illustrates a structure of a known projectile.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

Figure 2:
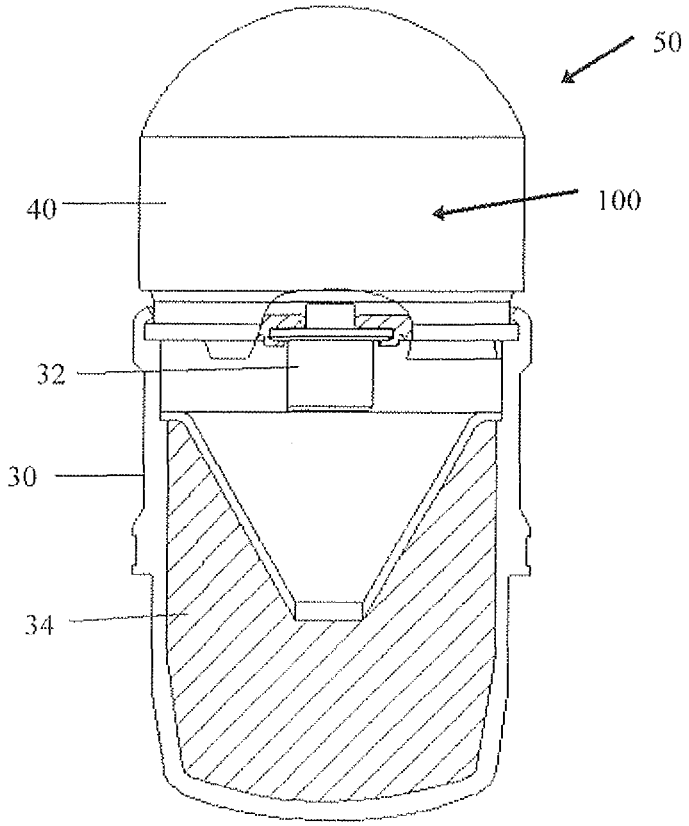
FIG. 2 illustrates a projectile according to an embodiment of the present invention.
Figure 2A:
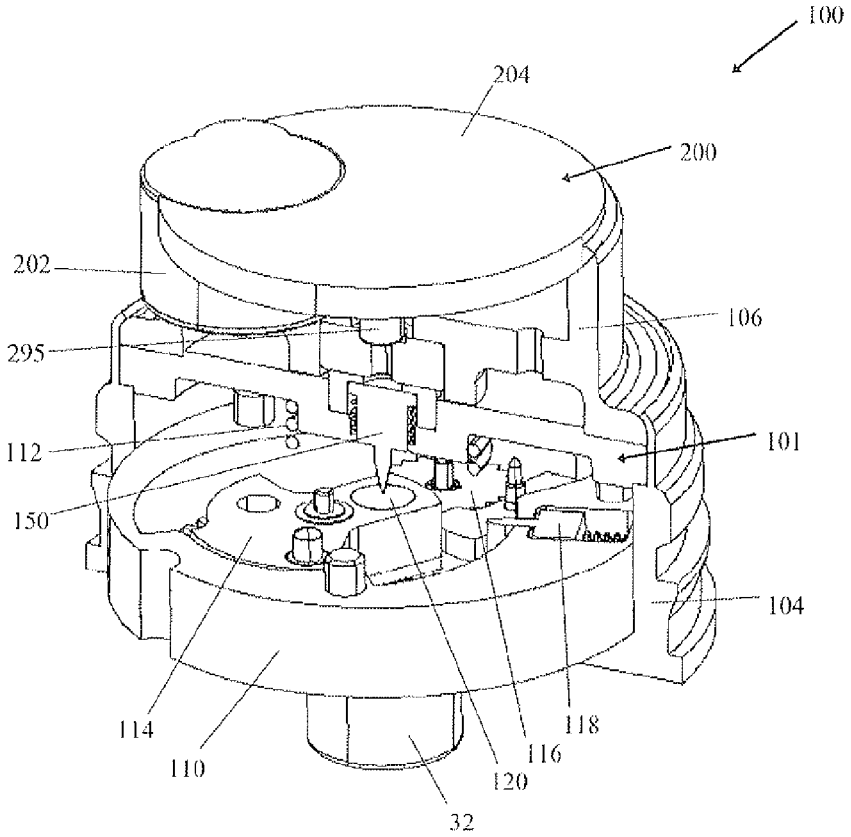
FIG. 2A illustrates a cut out perspective view of an electro-mechanical fuze disposed inside a nose cone of the projectile shown in FIG. 2 according to an embodiment of the present invention.

FIG. 2 shows a projectile 50 according to an embodiment of the present invention. An electro-mechanical fuze 100 is disposed in the nose cone 40 of the projectile 50. As shown in FIG. 2A, the electro-mechanical fuze 100 comprises a mechanical fuze 101 and an electronic fuze circuit 200. The electro-mechanical fuze 100 comprises a housing 104 and a frame 106 built on the housing 104. The housing 104 encloses a safe-and-arm assembly unit 110 and a firing pin 150. A printed circuit board (PCB) 204 containing the electronic fuze circuit 200 is mounted on the frame 106 together with a setback generator 202 and an electric detonator 295. The electric detonator 295 is aligned on top of the firing pin 150. As can be seen in FIG. 2A, the safe-and-arm assembly unit 110 is biased rearwardly by a retaining spring 112. A base of the housing 104 has an opening, fitted to which is a booster charge 32.

Figure 2B:
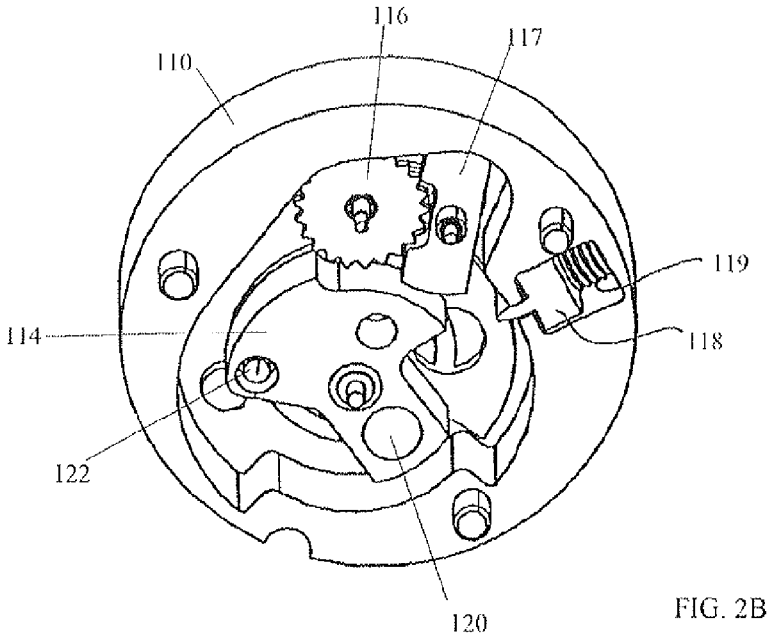
FIGS. 2B-2E illustrate rear views of a safe-and-arm assembly unit used in the fuze shown in FIG. 2A at various stages of rotation between safe and armed positions.
Figure 2C:
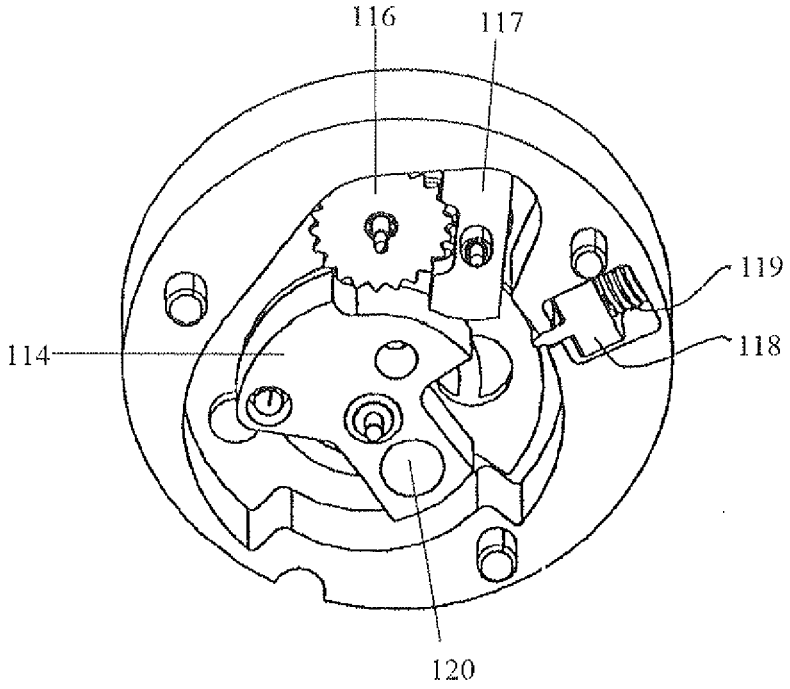
Figure 2D:
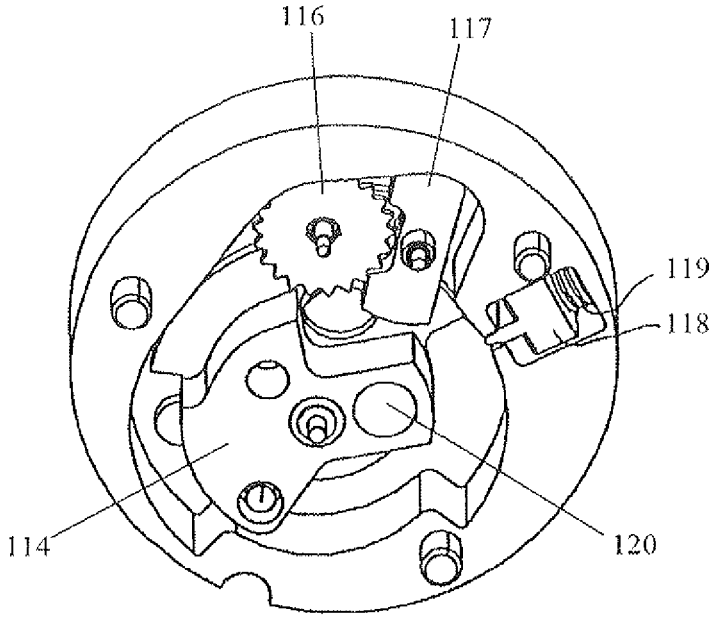
Figure 2E:
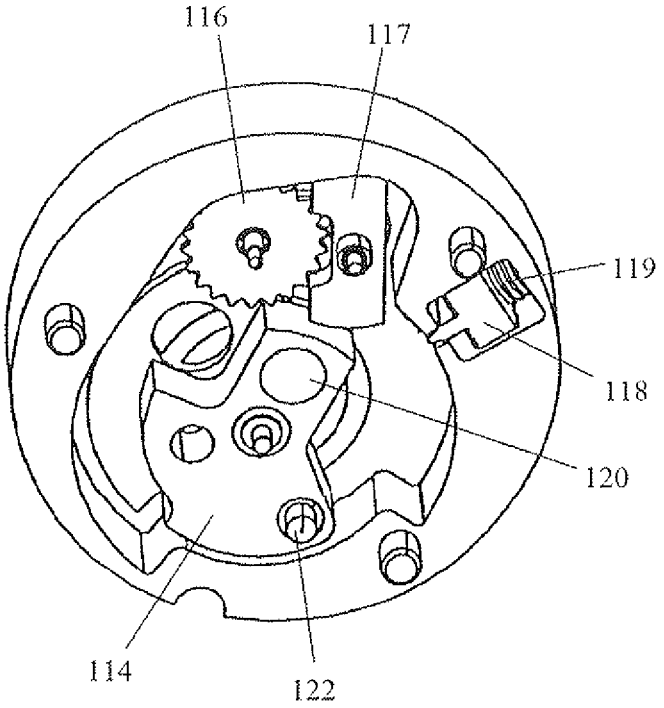

Pivoted in the housing 104 is an unbalanced rotor 114, a pinion assembly 116 and a verge assembly 117. The rotor 114 has a stab detonator 120 and an arming lock pin 122. The rotor 114 is mounted so that in a "safe" position, as shown in rear view FIG. 2B, the stab detonator 120 is not aligned with the firing pin 150. To keep the rotor 114 in the "safe" position, the safe-and-arm assembly unit 110 has a detent 118 and a spring 119 acting on the detent. In this "safe" position, the detent 118 is extended to lock the rotor 114 from rotating. As the projectile 50 is propelled through the barrel, the projectile 50 spins around its longitudinal axis 12 and centrifugal forces act on the detent 118 to retract it against the spring 119. FIG. 2C shows the detent 118 is partially retracted whilst FIG. 2D shows the detent 118 is fully retracted. As seen in FIGS. 2B-2D, the pinion assembly 116 engages with the verge assembly 117, which is operable to oscillate and periodically delay rotation of the pinion assembly 116 so that after the projectile 50 has been propelled beyond the minimum safe muzzle distance, the rotor 114 is rotated to its "armed" position, that is, after a predetermined delay arming time; in the "armed" position, the stab detonator 120 becomes aligned with the firing pin 150, as seen in FIG. 2A. As shown in FIG. 2E, the rotor 114 remains held in this armed position by the arming lock pin 122. When the nose cone 40 strikes a target at a designed or optimum angle, during such a point impact detonation mode, impact forces thrust the safe-and-arm assembly unit 110 forward against the firing pin 150, thereby setting off the stab detonator 120. The firing pin 150 is non-compliant in the forward direction as the stab detonator 120 is thrust onto the firing pin 150 but the firing pin 150 is compliant in the rearward direction, as will be appreciated, when it is actuated by the electric detonator 295. In this manner, initiation of the stab detonator 120 in turn sets off the booster charge 32 and/or explosive charge 34 disposed inside the body 30 of the projectile 50.

Figure 3:
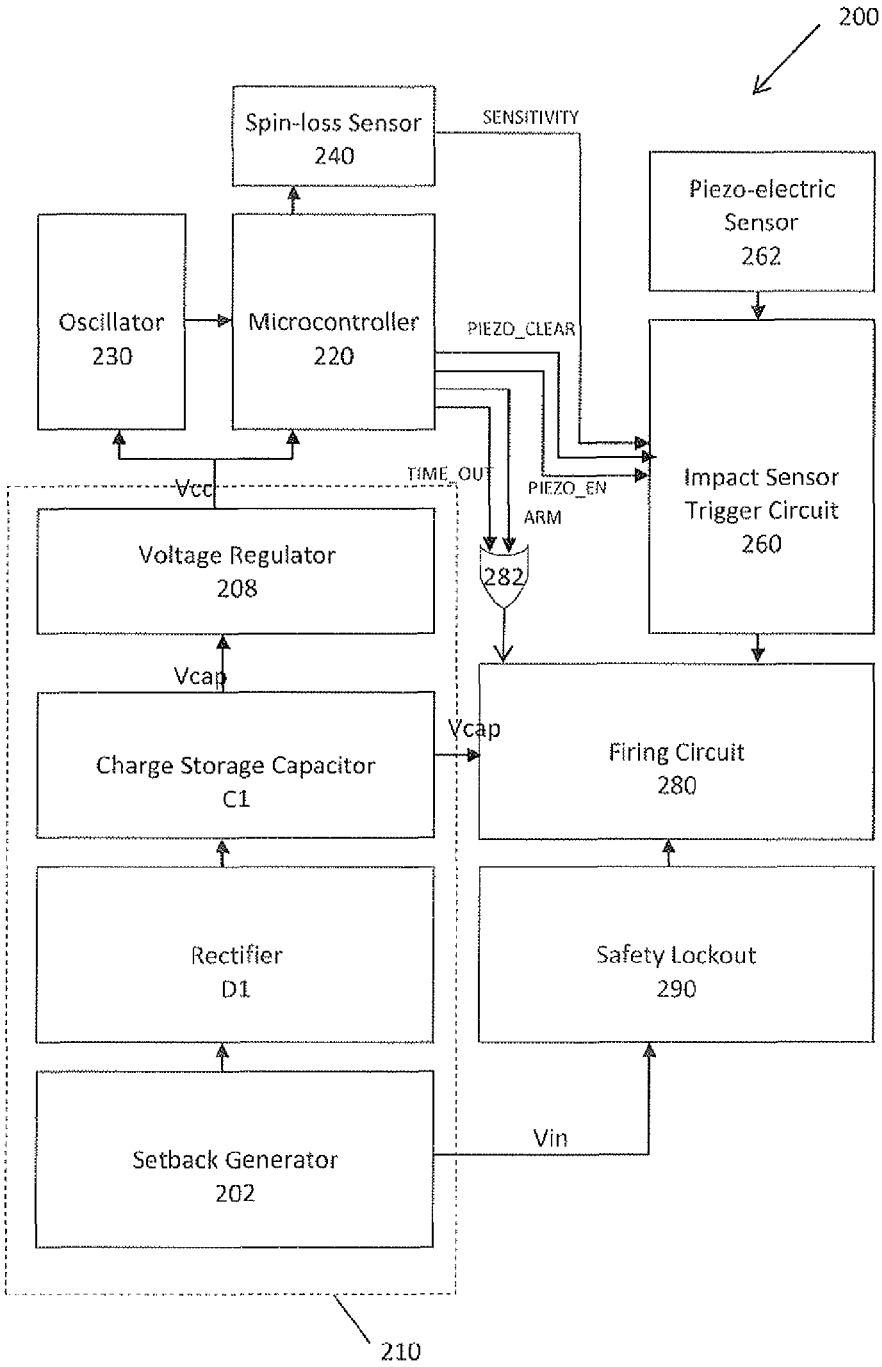
FIG. 3 illustrates a block diagram of an electronic fuze system implemented in the electro-mechanical fuze shown in FIG. 2A according to another embodiment of the present invention.

FIG. 3 shows functional block diagrams of the electronic fuze circuit 200 according to an embodiment of the present invention. As shown in FIG. 3, the electronic fuze circuit 200 comprises at least a power generation circuit 210, a micro-controller 220, a spin-loss sensor 240, an impact sensor trigger circuit 260, a firing circuit 280 and a safety lockout circuit 290.

As shown in FIG. 3A, the power generation circuit 210 comprises at least a setback generator 202, a diode D1, charge storage capacitors C1,C2 and a voltage regulator 208. The setback generator 202 is mounted on the frame 106. As soon as the projectile 50 is fired in the barrel of a weapon, displacement of a magnet within the setback generator 202 generates an electric voltage pulse Vin. Vin is rectified by the diode D1 and electric power is then stored in two charge storage capacitors C1, C2. A zener diode D2 and a resistor R1 are provided across the capacitors C1, C2. Zener diode D2 limits the peak voltage to capacitors C1, C2 while R1, of about 1 Mohm, allows the capacitors C1, C2 to discharge slowly, for eg. in 30 minutes, in the event that the projectile 50 fails to explode. Initial charged voltage Vcap from the storage capacitors C1 is too high to be used by downstream digital circuits. Vcap is thus regulated by the voltage regulator 208, which provides a regulated voltage Vcc, say at about 3.3V. The voltage regulator 208 is a low voltage dropout and low quiescent current type. Capacitor C3 is provided to maintain stable operation of the voltage regulator 208.

As shown in FIGS. 3 and 3B, the regulated voltage Vcc is supplied to a micro-controller 220. The micro-controller 220 is a low power 8-bit mixed signal microprocessor. The micro-controller 220 is periodically activated from its sleep mode by an oscillator 230 to reduce its power consumption. The micro-controller 220 performs time keeping and controls some safety inhibit lines, and its functions will be clearer when the other components of the electronic fuze circuit 200 are described. In one embodiment, the micro-controller 220 outputs an ARM signal; in another embodiment, the micro-controller 220 outputs a digital-to-analogue converter (DAC) signal.

Referring again to FIG. 3B, the spin-loss sensor 240 is connected to inputs of the micro-controller 220. FIG. 3B1 shows the spin-loss sensor 240 with its electrical contacts A1, A2, A3. After the projectile 50 is propelled inside the barrel, the spin-loss sensor 240 experiences high initial centrifugal accelerations, which reach a maximum when the projectile 50 exits from the muzzle before centrifugal accelerations slowly decrease. In response to high centrifugal accelerations, a ball 241 in the spin-loss sensor 240 is forced to slide radially along a channel against a spring 242. As shown in FIG. 3B1, movement of the ball 241 closes electrical contacts at A1, A2 and A3. After experiencing maximum acceleration, centrifugal forces on the ball 241 decrease gradually and the spring 242 responsively restores the ball 241 towards its non-activated position, thereby causing the ball 241 to close electrical contacts in a reverse manner, that is, from A3, to A2 and then back to A1 position. For safety consideration, it is only after the A1 electrical contact is activated the second time that the A1 signal sets a flag in the micro-controller 220. In response, the micro-controller 220 outputs a self destruct TIME_OUT signal after substantially between 9 and 30 seconds, so that after a projectile fails to explode after being deployed, the TIME_OUT signal can initiate self-destruction of the projectile 50. The micro-controller 220 also outputs PIEZO_CLR, PIEZO_EN and ARM signals. The PIEZO_CLR signal is to clear the state of a piezo-electric sensor 262 shown in FIG. 3C or 3C1 before the piezo-electric output signal is processed by the electronic fuze circuit 200. The piezoelectric enable (or PIEZO_EN) signal, complementary to the PIEZO_CLR signal, is provided to enable the piezo-electric sensor 262 output to generate a firing signal during impact sensing. In one embodiment, the ARM signal is a high-to-low pulse to ensure that the electronic fuze circuit 200 is not activated by spurious noise.

Figure 3C:
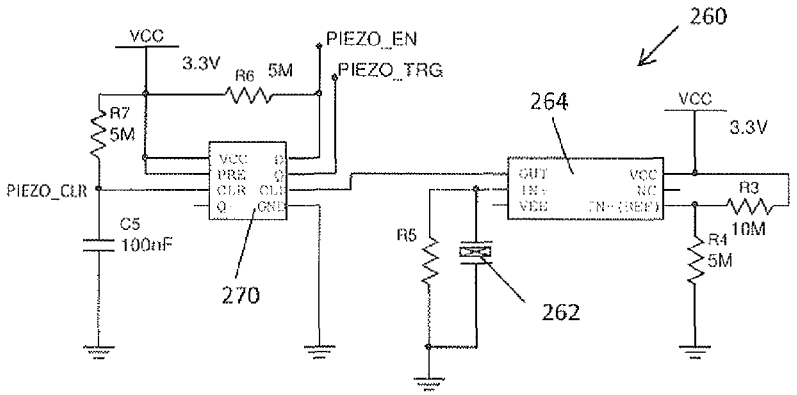
FIG. 3C illustrates an impact sensing trigger circuit for use with the fuze system shown in FIG. 3 according to another embodiment of the present invention.

FIG. 3C shows the impact sensor trigger circuit 260 according to another embodiment of the present invention. As shown in FIG. 3C, the piezo-electric sensor 262 is connected to a non-inverting (+) terminal of a voltage comparator 264 while a reference voltage is connected to an inverting (−) terminal. The reference voltage is provided by tapping the regulated voltage supply Vcc at a voltage divider formed by resistors R3 and R4. When the projectile 50 experiences an impact, a voltage spike generated by the piezo-electric sensor 262 is momentarily higher than the reference voltage and thus the output of the voltage comparator 264 turns high. As shown in FIG. 3C, the output of the voltage comparator 264 is connected to the clock terminal of a D-latch 270. In response, with a rising pulse at the clock terminal of the D-latch 270, the PIEZO_EN signal input at the D terminal of the D-latch 270 turns the Q output high. A piezo-electric sensing trigger (or PIEZO_TRG) signal is then sent to the firing circuit 280. In another embodiment, the PIEZO_CLR signal is forced by the micro-controller 220 to a clear (or CLR) input terminal of the D-latch 270, whilst the PIEZO_EN signal is forced to enable impact sensing.

FIG. 3C1 shows an impact sensor trigger circuit 260*a* according to another embodiment of the present invention. The impact sensor trigger circuit 260*a* is similar to the previous circuit 260 except that the reference voltage is now driven by the DAC output from the micro-controller 220, as shown in FIG. 3C1. In one embodiment, the DAC output is varied from a high level to a relatively lower level over time. This is advantageous in that the impact sensor trigger circuit 260*a* is made more sensitive as the projectile 50 approaches its target. Tests have shown that the electronic fuze circuit 200 is able to detect impact even when the projectiles 50 struck at oblique angles at their targets during which the mechanical point impact detonation mode is ineffective. The other advantage is that the response time of the impact sensor trigger circuits 260, 260*a* is shorter than the mechanical point detonation response time.

Figure 3D:
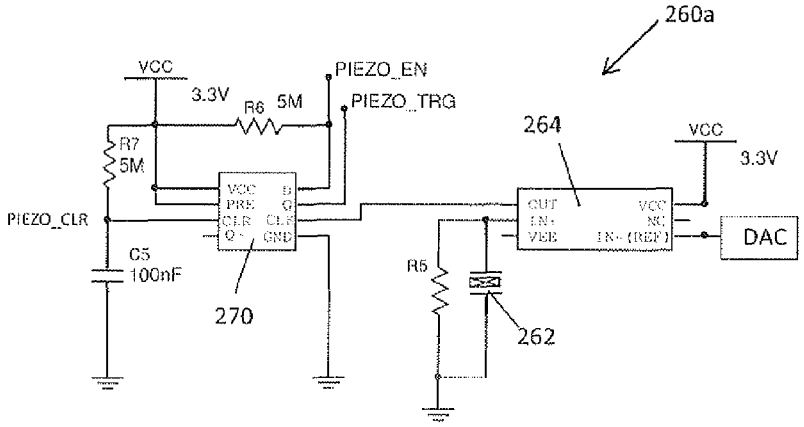
FIG. 3D illustrates a firing and safety lock-out circuit for use with the fuze system shown in FIG. 3 according to yet another embodiment of the present invention.
Figure 3D:
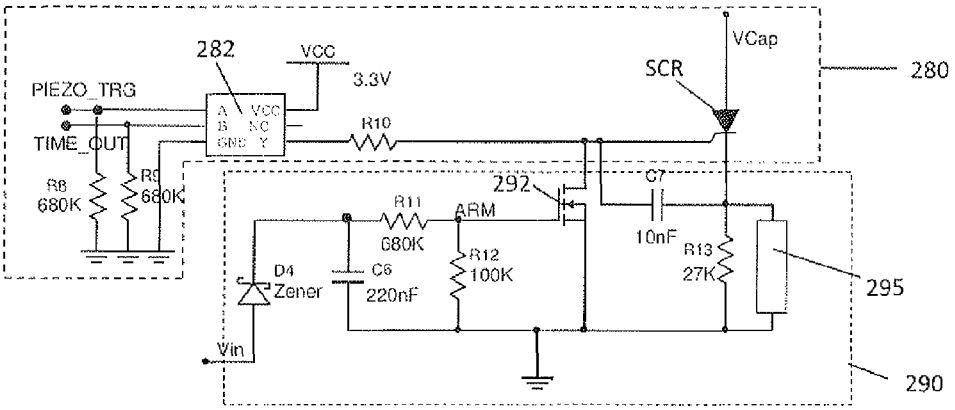

FIG. 3D shows the firing circuit 280 and safety lock-out circuit 290 according to other embodiments of the present invention. In the firing circuit 280, the TIME_OUT signal output from the micro-controller 220 and the PIEZO_TRG output from the D-latch 270 are connected to an OR gate 282. The output of the OR gate 282 is operable to drive a gate voltage line of a silicon-controlled rectifier SCR. As shown in FIG. 3D, the SCR gate voltage line is connected to the safety lockout circuit 290.

As shown in FIG. 3D, the safety lockout circuit 290 comprises an n-channel field-effect transistor (FET) 292, whose drain is connected to the SCR gate voltage line and source is connected to ground. The gate of the FET 292 is connected to a voltage divider and Zener diode D4 with the voltage pulse Vin supplied by the setback generator 202. A positive FET gate voltage causes the gate channel of the FET 292 to conduct; as a result, the SCR gate voltage is pulled down to ground and this provides a safety lockout until the electronic fuze circuit 200 is armed. The voltage at the gate of the FET 292 decreases as the projectile 50 is being propelled towards its target. When the voltage at the gate of the FET 292 is too low to hold the FET 292 in conduction and it becomes turned OFF, the electronic fuze circuit 200 becomes armed. The PIEZO_TRG or TIME_OUT signal at the inputs of the OR gate 282 turns the output of the OR gate 282 high to provide a firing signal to the SCR. The firing signal at the SCR gate turns ON the SCR and electric energy Vcap stored in the charge capacitors C1,C2 is then delivered to initiate the electric detonator 295.

In another embodiment of the safety lockout circuit 290, the ARM signal from the micro-controller 220 is connected to the gate voltage line of the n-channel FET 292. The ARM signal is a high-to-low signal. Before the electronic fuze circuit 200 is armed, the ARM signal is high and this forced voltage at the gate of the n-channel FET 292 causes it to conduct and pulls the gate voltage line of the SCR down to ground. When the electronic fuze circuit 200 is armed, the ARM signal is turned low and the n-channel FET 292 becomes turn OFF, so that a firing signal is sent to the SCR gate to turn the SCR ON, thereby allowing electric energy Vcap stored in the charge capacitors C1,C2 to be delivered to initiate the electric detonator 295.

In another embodiment, the impact sensor trigger circuit 260 is functionally independent. This is a fail-safe feature of the electronic fuze circuit 200 of the present invention, for example, in the event of failure or malfunction of the micro-controller 220. As can be seen from FIG. 3C, the regulated voltage supply Vcc is coupled to both the PIEZO)_CLR and PIEZO_EN lines; thus, the PIEZO_EN line is constantly enabled as soon as the projectile 50 is deployed.

From FIG. 2A one will appreciate that the mechanical fuze 101 involves movements of many precision parts, such as, the rotor 114, pinion assembly 116, verge assembly 117 and firing pin 150. For example, when the projectile 50 strikes at an oblique angle on a hard target, the projectile 50 may ricochet, during which the body 30 of the projectile 50 may slam on its target. In some incidents, this may result in the firing pin 150 becoming offset or misaligned with a centre of the stab detonator 120. The frame 104 may also become misaligned. In other incidents, the components of the mechanical fuze 101 may become misaligned and inoperative. Misalignment of the stab detonator 120 may affect the explosive train with the booster charge 32. As the explosive charge 34 in the body of the projectile 50 is a distance behind the booster charge 32, any misalignment of the booster charge 32 may also affect detonation of the explosive charge 34. As response time of the electronic fuze circuit 200 is faster than the response time of the mechanical fuze 101, the impact sensor trigger circuit 260, 260*a* is provided to trigger a firing signal before any offset or misalignment of the mechanical fuze 101 sets in. Fractions of a millisecond after the projectile 50 struck at an oblique angle at a hard target is all the time for the impact sensor trigger circuit 260, 260*a* to trigger and the firing circuit 280 to respond; the electronic fuze circuit 200 of the present invention has been designed to achieve this. From tests conducted, the overall reliability of the electro-mechanical fuze 100 of the present invention increased to about 99% or more with 95% confidence level or higher.

While specific embodiments have been described and illustrated, it is understood that many changes, modifications, variations and combinations thereof could be made to the present invention without departing from the scope of the present invention. The scope of the present invention is now defined in the claims and as supported by the description and drawings:

The invention claimed is:

1. A fuze for a projectile comprising:

a set-back generator to supply electric power after said fuze is launched;

an impact sensor trigger circuit and a safety lockout circuit coupled to an electronic firing circuit; wherein said impact sensor trigger circuit comprises a piezo-electric sensor; and an electric detonator being disposed co-axially in-line to actuate a firing pin;

wherein, upon impact of said projectile on a target, said piezo-electric sensor generates and sends a firing signal, depending on said safety lockout circuit, to said electronic firing circuit to set off said electric detonator, and detonation of said electric detonator in turn is operated to actuate said firing pin to set off a stab detonator disposed in said projectile.

2. A fuze according to claim 1, wherein said firing pin is non-compliant in a forward direction in relation to direction of travel of said projectile to allow said firing pin to set off said stab detonator but is compliant in a rearward direction, so that when said electric detonator is set off, a thrust is generated to actuate said firing pin onto said stab detonator.

3. A fuze according to claim 1, wherein said safety lockout circuit comprises an n-channel field-effect transistor (PET) whose drain is connected to a gate of a silicon-controlled rectifier (SCR) and source is connected to ground, such that after said projectile has been propelled through a tactical distance, a voltage pulse Vin generated by said set-back generator decreases to a predetermined low level so that a voltage applied to a gate voltage line of said n-channel FET can no longer hold said n-channel FET in conduction, said n-channel FET becomes turned OFF, and as a result, said safety lockout circuit becomes deactivated and said firing signal is then sent to said gate of said SCR to turn said SCR ON, which in response is operable to set off said electric detonator.

4. A fuze according to claim 3, further comprising:

a micro-controller, which outputs ARM, piezo enable (or PIEZO_EN) and piezo clear (or PIEZO_CLR) signals according to predetermined clock periods set in said micro-controller.

5. A fuze according to claim 4, further comprising a spin-loss sensor, which output sets a flag in said micro-controller and outputs a TIME_OUT self destruct signal.

6. A fuze according to claim 4, wherein said impact sensor trigger circuit comprises a gated D-latch, to which output of said impact sensor trigger circuit is connected to a clock (or CLK) input of said gated D-latch, with said PIEZO_EN being connected to a D input, said PIEZO_CLR signal being connected to a clear (or CLR) input and a PIEZO_TRG is outputted at a Q terminal.

7. A fuze according to claim 6, wherein said electronic firing circuit comprises an OR gate, wherein said PIEZO_EN signal allows said PIEZO_TRG signal or said TIME_OUT signal to be inputted into said OR gate to generate said firing signal.

8. A fuze according to claim 4, wherein said ARM signal is connected to said gate voltage line of said n-channel FET.

9. A fuze according to claim 8, wherein said ARM signal comprises a high-to-low signal.

10. A fuze according to claim 1, wherein output of said piezo-electric sensor is connected to an non-inverting terminal of a voltage comparator whilst a reference voltage tapped from a voltage divider is connected to an inverting terminal.

11. A fuze according to claim 10, wherein said micro-controller outputs a digital-to-analogue (DAC) signal, which is operable to drive said reference voltage at said voltage comparator.

12. A fuze according to claim 11, wherein said DAC signal is time varied from a high to a relative low level, so that sensitivity of said piezo-electric sensor is responsively increased as said projectile approaches its target.

13. A fuze according to claim 1, further comprising a safe-and-arm assembly unit, on which said stab detonator is rotatable so that after said projectile has been propelled to a minimum muzzle safety distance, said stab detonator becomes aligned with said firing pin.

* * * * *